US010398195B1

(12) United States Patent
Donaghue

(10) Patent No.: US 10,398,195 B1
(45) Date of Patent: Sep. 3, 2019

(54) SHOE SOLE COVERING

(71) Applicant: Vincent Donaghue, Parker, CO (US)

(72) Inventor: Vincent Donaghue, Parker, CO (US)

( * ) Notice: Subject to any disclaimer, the term of this patent is extended or adjusted under 35 U.S.C. 154(b) by 112 days.

(21) Appl. No.: 15/695,082

(22) Filed: Sep. 5, 2017

(51) Int. Cl.

| | |
|---|---|
| ***A43B 3/16*** | (2006.01) |
| ***A43B 13/32*** | (2006.01) |
| ***A43B 13/22*** | (2006.01) |
| ***A43B 13/04*** | (2006.01) |

(52) U.S. Cl.
CPC ..... *A43B 13/32* (2013.01); *A43B 3/16* (2013.01); *A43B 13/04* (2013.01); *A43B 13/223* (2013.01)

(58) Field of Classification Search
CPC ..... A43B 13/04; A43B 3/124; A43B 3/106; A43B 3/16
USPC ..... 36/7.5, 7.1 R
See application file for complete search history.

(56) References Cited

U.S. PATENT DOCUMENTS

| | | | | |
|---|---|---|---|---|
| 3,903,620 | A | 9/1975 | Gillet | |
| 4,811,444 | A | 3/1989 | Hamblin | |
| 4,924,608 | A | 5/1990 | Mogonye | |
| D575,874 | S | 8/2008 | Ormsby | |
| 8,024,872 | B2 * | 9/2011 | Pettis | A43B 13/36 36/132 |
| 8,528,150 | B1 | 9/2013 | Mellott | |
| 8,789,297 | B1 * | 7/2014 | Doyle | A43B 5/005 36/130 |
| 9,215,910 | B2 | 12/2015 | Dhillon | |
| 2006/0101667 | A1 | 5/2006 | Kane | |
| 2006/0207123 | A1 * | 9/2006 | Milner | A43B 1/0045 36/44 |
| 2007/0051014 | A1 * | 3/2007 | Cromley | A43B 5/18 36/7.3 |
| 2009/0113646 | A1 | 5/2009 | Rossell | |
| 2010/0115795 | A1 * | 5/2010 | Stead | A43B 3/24 36/102 |
| 2010/0174004 | A1 * | 7/2010 | Wu | A43B 1/0063 521/84.1 |
| 2011/0225847 | A1 * | 9/2011 | Buchanan | A43B 5/08 36/96 |
| 2014/0102921 | A1 * | 4/2014 | Chapuseaux | A43B 3/106 206/278 |
| 2016/0015116 | A1 * | 1/2016 | Jones | A43B 3/106 36/84 |

* cited by examiner

*Primary Examiner* — Ted Kavanaugh
(74) *Attorney, Agent, or Firm* — Kyle A. Fletcher, Esq.

(57) ABSTRACT

The shoe sole covering is configured for use with a shoe. The shoe sole covering is configured to attach to the sole of the shoe. The sole of the shoe is further defined with an insole and an outsole. The shoe sole covering attaches to the outsole of the shoe to form a barrier between the shoe and a supporting surface. The barrier prevents cross-contamination between the supporting surface and the shoe. The shoe sole covering is a disposable product that is biodegradable. The shoe sole covering is also degradable primarily through hydrolysis reactions. The shoe sole covering comprises a vamp guard, a heel guard, an arch union, and a tab. The arch union attaches the vamp guard to the heel guard. The tab attaches to the heel guard.

19 Claims, 4 Drawing Sheets

SHOE SOLE COVERING

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including footwear, more specifically, an overshoe configured for hygienic purposes.

SUMMARY OF INVENTION

The shoe sole covering is configured for use with a shoe. The shoe sole covering is configured to attach to the sole of the shoe. The sole of the shoe is further defined with an insole and an outsole. The shoe sole covering attaches to the outsole of the shoe to form a barrier between the shoe and a supporting surface. The barrier prevents cross-contamination between the supporting surface and the shoe. The shoe sole covering is a disposable product that is biodegradable. The shoe sole covering is also degradable primarily through hydrolysis reactions. The shoe sole covering comprises a vamp guard, a heel guard, an arch union, and a tab. The arch union attaches the vamp guard to the heel guard. The tab attaches to the heel guard.

These together with additional objects, features and advantages of the shoe sole covering will be readily apparent to those of ordinary skill in the art upon reading the following detailed description of the presently preferred, but nonetheless illustrative, embodiments when taken in conjunction with the accompanying drawings.

In this respect, before explaining the current embodiments of the shoe sole covering in detail, it is to be understood that the shoe sole covering is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the shoe sole covering.

It is therefore important that the claims be regarded as including such equivalent construction insofar as they do not depart from the spirit and scope of the shoe sole covering. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
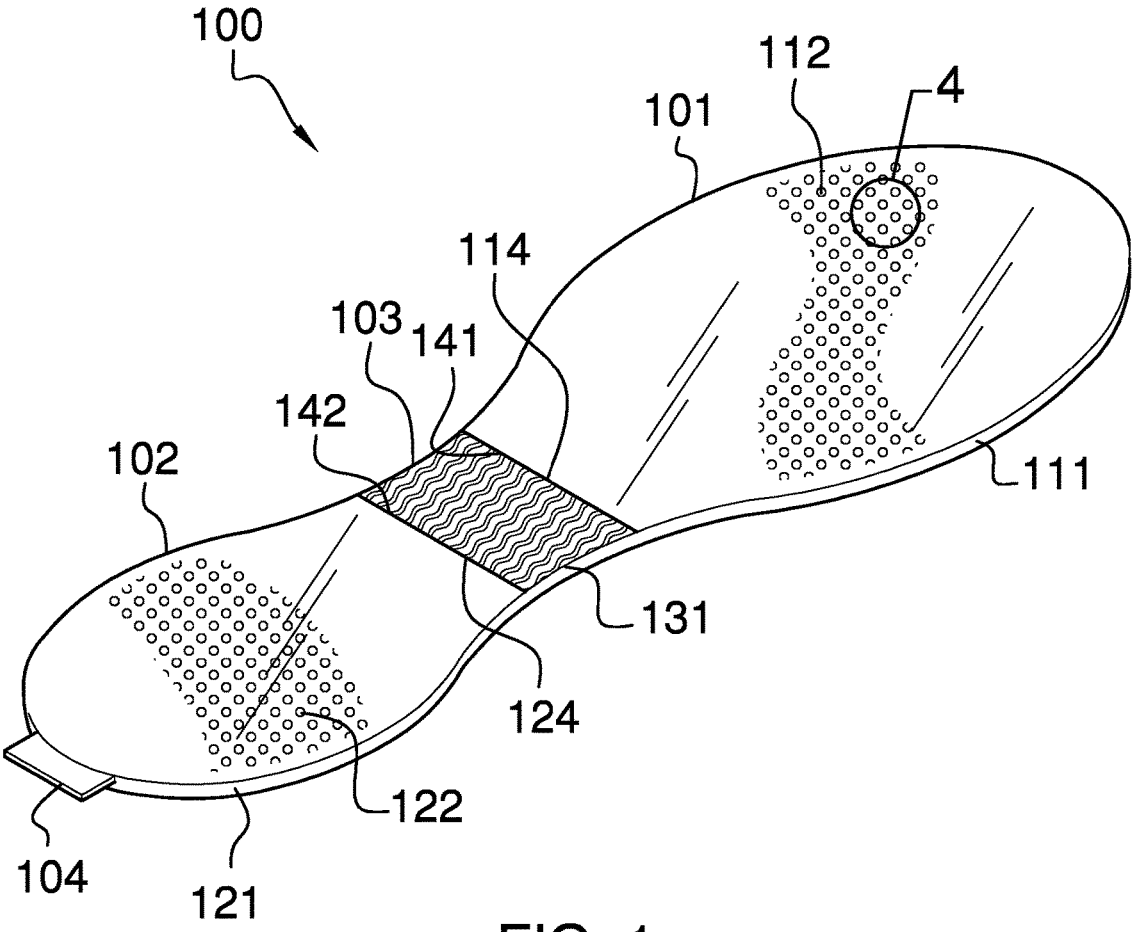
FIG. 1 a perspective view of an embodiment of the disclosure.
Figure 2:
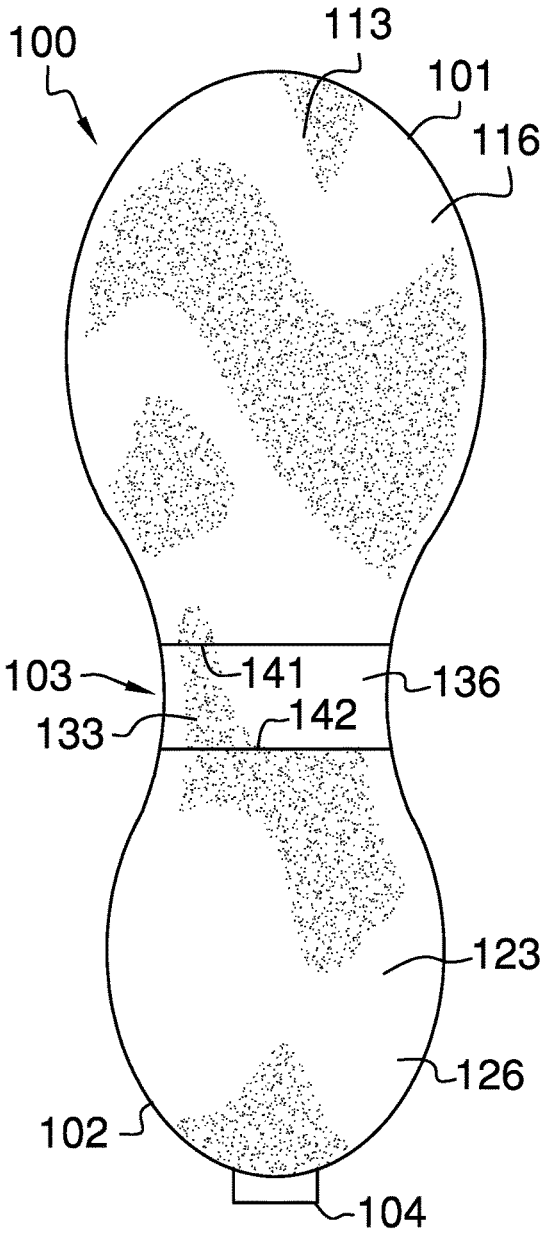
FIG. 2 is a superior view of an embodiment of the disclosure.
Figure 3:
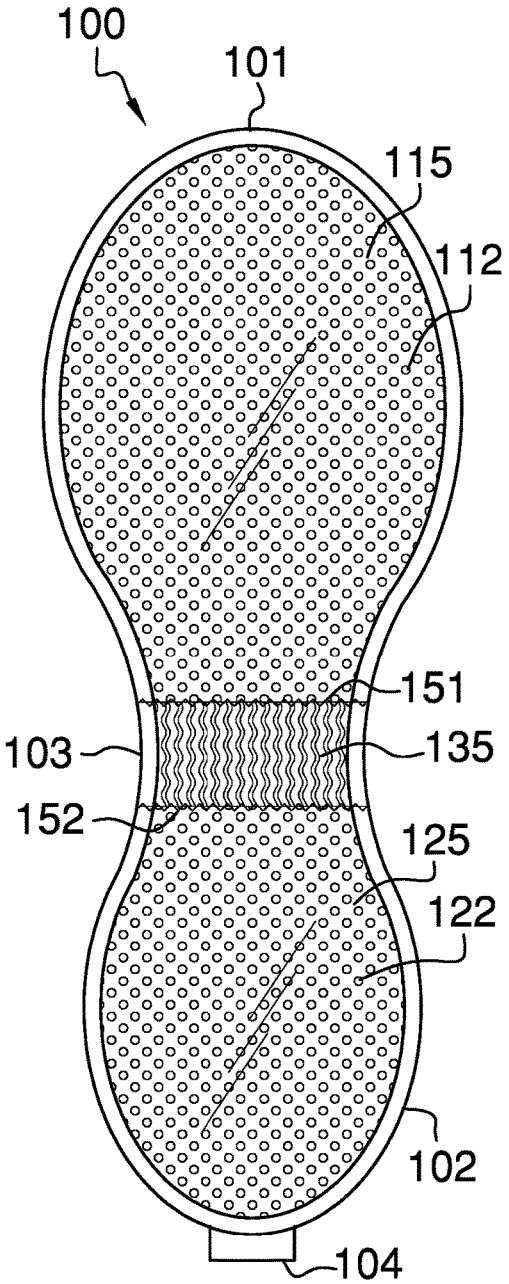
FIG. 3 is an inferior view of an embodiment of the disclosure.
Figure 4:
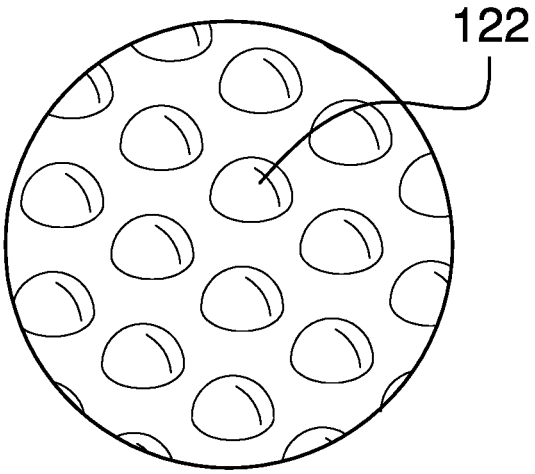
FIG. 4 is a detail view of an embodiment of the disclosure.
Figure 5:
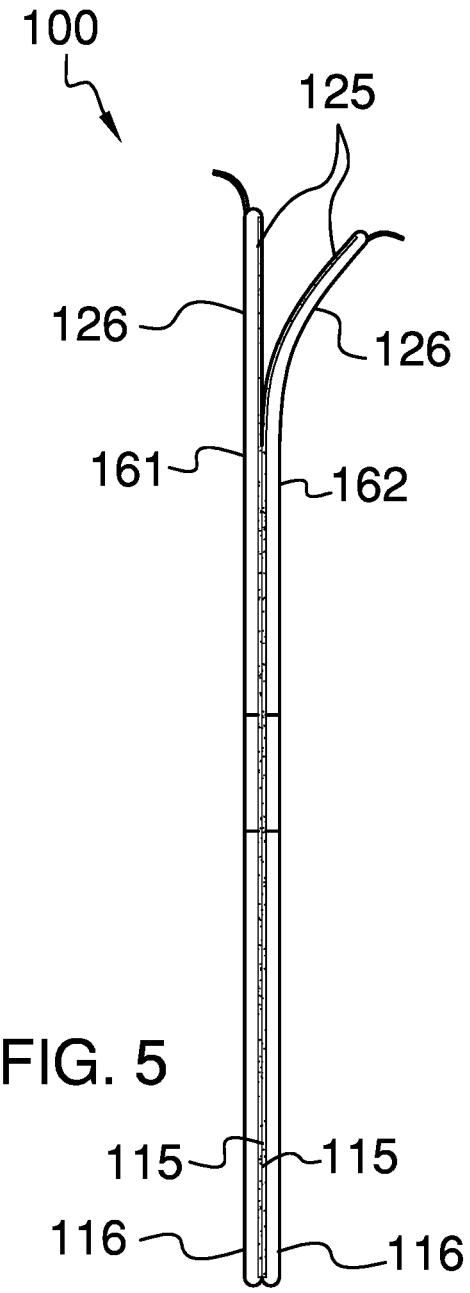
FIG. 5 is a side view of an embodiment of the disclosure.
Figure 6:
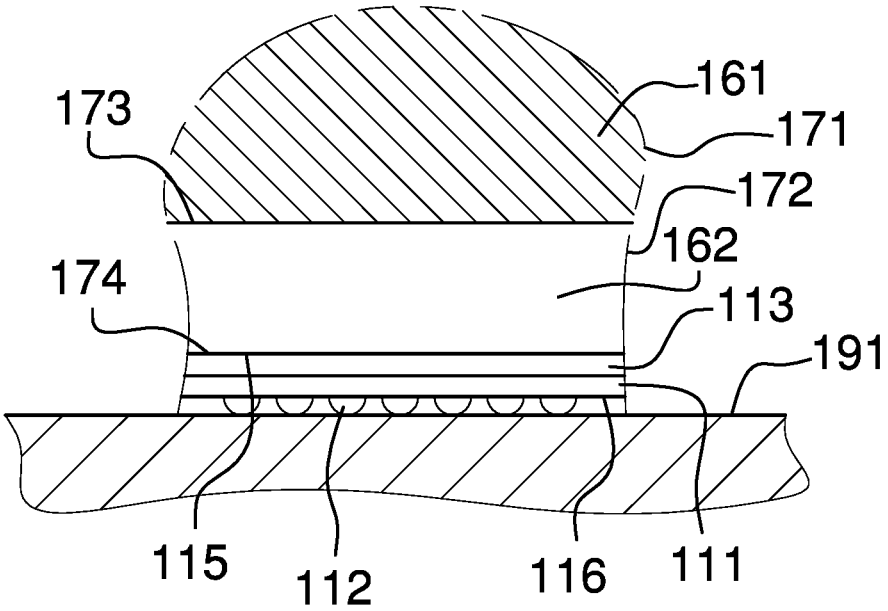
FIG. 6 is an in use view of an embodiment of the disclosure.

Detailed reference will now be made to one or more potential embodiments of the disclosure, which are illustrated in FIGS. 1 through 6.

The shoe sole covering 100 (hereinafter invention) is configured for use with a shoe 171. The invention 100 is configured to attach to the sole 172 of the shoe 171. The sole 172 of the shoe 171 is further defined with an insole 173 and an outsole 174. The invention 100 attaches to the outsole 174 of the shoe 171 to form a barrier between the shoe 171 and a supporting surface 191. The barrier prevents cross-contamination between the supporting surface 191 and the shoe 171. The invention 100 is a disposable product that is biodegradable. The invention 100 is also degradable primarily through hydrolysis reactions. The invention 100 comprises a vamp guard 101, a heel guard 102, an arch union 103, and a tab 104. The arch union 103 attaches the vamp guard 101 to the heel guard 102. The tab 104 attaches to the heel guard 102.

The vamp guard 101 is a furcation of the invention 100 that attaches to the outsole 174 of the sole 172 of the shoe 171 in an inferior position relative to the vamp of the shoe 171. The vamp guard 101 comprises a vamp sheeting 111, a vamp plurality of knurls 112, a vamp adhesive layer 113 and a vamp linear junction 114. The vamp sheeting 111 is further defined with a vamp inferior surface 115 and a vamp superior surface 116.

The vamp sheeting 111 is a sheeting roughly formed in the shape of an oval. The vamp sheeting 111 is intended for a single use. The vamp sheeting 111 is a biodegradable structure. In the first potential of the disclosure, the sheeting used in the vamp sheeting 111 is formed from a lactic acid (CAS 26100-51-6) polymer. The lactic acid forms a degradable and biodegradable polymer.

The vamp plurality of knurls 112 are formed on the vamp inferior surface 115 of the vamp sheeting 111. Each of the vamp plurality of knurls 112 is a structure that projects away from the vamp inferior surface 115 of the vamp sheeting 111. The vamp plurality of knurls 112 forms a nonskid surface that prevents slipping while the invention 100 is in use. In the first potential embodiment of the disclosure, each of the vamp plurality of knurls 112 is a hemisphere. The vamp plurality of knurls 112 are arranged in a regular order. Methods to press shapes into a sheeting are well known and documented in the mechanical arts.

The vamp adhesive layer 113 adheres the vamp sheeting 111 to the outsole 174 of the sole 172. The vamp adhesive layer 113 is a commercially available removable adhesive. The vamp adhesive layer 113 is a pressure sensitive adhesive. The vamp adhesive layer 113 is applied as a layer to the vamp superior surface 116 of the vamp sheeting 111. Methods to apply a layer of a chemical to a sheeting are well known and documented in the textile arts. Methods to select an adhesive suitable for use as the vamp adhesive layer 113 are well-known in manufacturing arts.

The vamp linear junction 114 is a portion of the perimeter of the vamp sheeting 111 that forms a straight line. The vamp linear junction 114 forms the posterior edge of the vamp guard 101. The span of the length of the vamp linear junction 114 equals the span of the first arch linear junction 141.

The vamp inferior surface 115 is the surface of the vamp sheeting 111 that is distal from the outsole 174 of the sole 172 when the vamp guard 101 is properly applied to the outsole 174 of the sole 172. The vamp superior surface 116 is the surface of the vamp sheeting 111 that is attached to the outsole 174 of the sole 172 when the vamp guard 101 is properly applied to the outsole 174 of the sole 172.

The heel guard 102 is a furcation of the invention 100 that attaches to the outsole 174 of the sole 172 of the shoe 171 in an inferior position relative to the quarter of the shoe 171. The heel guard 102 comprises a heel sheeting 121, a heel plurality of knurls 122, a heel adhesive layer 123 and a heel linear junction 124. The heel sheeting 121 is further defined with a heel inferior surface 125 and a heel superior surface 126.

The heel sheeting 121 is a sheeting roughly formed in the shape of an oval. The heel sheeting 121 is intended for a single use. The heel sheeting 121 is a biodegradable structure. In the first potential of the disclosure, the sheeting used in the heel sheeting 121 is formed from a lactic acid (CAS 26100-51-6) polymer. The sheeting that forms the heel sheeting 121 is identical to the sheeting that forms the vamp sheeting 111. The heel plurality of knurls 122 are formed on the heel inferior surface 125 of the heel sheeting 121. Each of the heel plurality of knurls 122 is a structure that projects away from the heel inferior surface 125 of the heel sheeting 121. The heel plurality of knurls 122 forms a nonskid surface that prevents slipping while the invention 100 is in use. In the first potential embodiment of the disclosure, each of the heel plurality of knurls 122 is a hemisphere. The heel plurality of knurls 122 are arranged in a regular order. Methods to press shapes into a sheeting are well known and documented in the mechanical arts.

The heel adhesive layer 123 adheres the heel sheeting 121 to the outsole 174 of the sole 172. The heel adhesive layer 123 is a commercially available removable adhesive. The heel adhesive layer 123 is a pressure sensitive adhesive. The heel adhesive layer 123 is identical to the vamp adhesive layer 113. The heel adhesive layer 123 is applied as a layer to the heel superior surface 126 of the heel sheeting 121. Methods to apply a layer of a chemical to a sheeting are well known and documented in the textile arts. Methods to select an adhesive suitable for use as the heel adhesive layer 123 are well-known in manufacturing arts.

The heel linear junction 124 is a portion of the perimeter of the heel sheeting 121 that forms a straight line. The heel linear junction 124 forms the anterior edge of the heel guard 102. The span of the length of the heel linear junction 124 equals the span of the second arch linear junction 142.

The heel inferior surface 125 is the surface of the heel sheeting 121 that is distal from the outsole 174 of the sole 172 when the heel guard 102 is properly applied to the outsole 174 of the sole 172. The heel superior surface 126 is the surface of the heel sheeting 121 that is attached to the outsole 174 of the sole 172 when the heel guard 102 is properly applied to the outsole 174 of the sole 172.

The tab 104 is a grip that allows the invention 100 to be pulled away from a surface to which the invention 100 may be attached. The tab 104 is cut as an extension of the heel sheeting 121. The heel adhesive layer 123 is not applied to the tab 104.

The arch union 103 is a furcation of the invention 100 that attaches to the outsole 174 of the sole 172 of the shoe 171 in an inferior position relative to the arch of the shoe 171. The arch union 103 comprises an arch sheeting 131, an arch adhesive layer 133, a first arch linear junction 141 and a second arch linear junction 142. The arch sheeting 131 is further defined with an arch inferior surface 135 and an arch superior surface 136.

The arch sheeting 131 is an elastic sheeting. The arch sheeting 131 is intended for a single use. The arch sheeting is a biodegradable structure. The elastic nature of the arch sheeting 131 allows the invention 100 to be "stretched to fit" as necessary to apply the invention 100 to the outsole 174 of the shoe 171. This elasticity allows the invention 100 to accommodate a shoe 171 selected of a plurality of shoes that have different form factors.

In the first potential embodiment of the disclosure, the arch sheeting 131 is formed from a block copolymer. Specifically, it is preferred that the block copolymer is formed from a polymer chain made of a lactic acid (CAS 26100-51-6) polymer chain and caprolactone (CAS 24980-41-4) polymer chain. A block copolymer formed from a lactic acid polymer and a caprolactone polymer is both degradable and biodegradable. Within this structure, the caprolactone is used as the switching (stretching) structure and the lactic acid is used as the rigid structure of the polymer chain. Methods to form block copolymers are well-known and documented in the chemical arts.

The arch adhesive layer 133 adheres the arch sheeting 131 to the outsole 174 of the sole 172. The arch adhesive layer 133 is a commercially available removable adhesive. The arch adhesive layer 133 is a pressure sensitive adhesive. The heel adhesive layer 123 is identical to the vamp adhesive layer 113. The arch adhesive layer 133 is applied as a layer to the arch superior surface 136 of the arch sheeting 131. Methods to apply a layer of a chemical to a sheeting are well known and documented in the textile arts. Methods to select an adhesive suitable for use as the arch adhesive layer 133 are well-known in manufacturing arts.

The arch inferior surface 135 is the surface of the arch sheeting 131 that is distal from the outsole 174 of the sole 172 when the arch union 103 is properly applied to the outsole 174 of the sole 172. The arch superior surface 136 is the surface of the arch sheeting 131 that is attached to the outsole 174 of the sole 172 when the arch union 103 is properly applied to the outsole 174 of the sole 172.

The first arch linear junction 141 is a portion of the perimeter of the arch sheeting 131 that forms a straight line. The first arch linear junction 141 forms the anterior edge of the arch union 103. The span of the length of the first arch linear junction 141 equals the span of the vamp linear junction 114. The second arch linear junction 142 is a portion of the perimeter of the arch sheeting 131 that forms a straight line. The second arch linear junction 142 forms the posterior edge of the arch sheeting 131. The span of the length of the second arch linear junction 142 equals the span of the heel linear junction 124.

The arch union 103 further comprises a first seam 151 and a second seam 152. It is anticipated that the sheetings that form the vamp sheeting 111, the heel sheeting 121, and the arch sheeting 131 will be joined together into a single sheeting using the first seam 151 and the second seam 152 such that the vamp sheeting 111, the heel sheeting 121, and the arch sheeting 131 will be cut as a single unit. It is further anticipated that the vamp adhesive layer 113, the heel adhesive layer 123, and the arch adhesive layer 133 will be applied to the single sheeting before the vamp sheeting 111, the heel sheeting 121, and the arch sheeting 131 are cut.

The first seam 151 attaches the vamp linear junction 114 of the vamp sheeting 111 to the first arch linear junction 141 of the arch sheeting 131 such that the vamp linear junction 114 of the vamp sheeting 111 aligns with the first arch linear junction of the arch sheeting 131.

The second seam 152 attaches the heel linear junction 124 of the heel sheeting 121 to the second arch linear junction 142 of the arch sheeting 131 such that the heel linear junction 124 of the heel sheeting 121 aligns with the second arch linear junction 142 of the arch sheeting 131.

In the first potential of the disclosure, the first seam 151 is formed using a heat bonding process. The second seam 152 is formed using a heat bonding process. The use of heat bonding processes to form a seam that joins two sheetings are well-known and documented in the textile arts.

It is anticipated that the invention 100 will be most useful when two instantiations of the invention 100 are used simultaneously.

The first instantiation of the invention 100 is referred to as the left sole guard 161. The second instantiation of the invention 100 is referred to as the right sole guard 162.

During storage before usage, the vamp adhesive layer 113 of the vamp inferior surface 115 of the left sole guard 161 is pressed against the vamp adhesive layer 113 of the vamp inferior surface 115 of the right sole guard 162 such that the vamp guard 101 of the left sole guard 161 and the vamp guard 101 of the right sole guard 162 adhere to and protect each other.

Similarly, the heel adhesive layer 123 of the heel inferior surface 125 of the left sole guard 161 is pressed against the heel adhesive layer 123 of the heel inferior surface 125 of the right sole guard 162 such that the vamp guard 101 of the left sole guard 161 and the vamp guard 101 of the right sole guard 162 adhere to and protect each other.

Similarly, the arch adhesive layer 133 of the arch inferior surface 135 of the left sole guard 161 is pressed against the arch adhesive layer 133 of the arch inferior surface 135 of the right sole guard 162 such that the vamp guard 101 of the left sole guard 161 and the vamp guard 101 of the right sole guard 162 adhere to and protect each other.

To use the invention 100, the tab 104 of the left sole guard 161 and the tab 104 of the right sole guard 162 are pulled apart to separate the left sole guard 161 from the right sole guard 162. The left sole guard 161 attaches to the sole 172 of a first shoe 171. The right sole guard 162 attaches to the sole of a second shoe 171.

The following definitions were used in this disclosure:

Adhesive: As used in this disclosure, an adhesive is a chemical substance that can be used to adhere two or more objects to each other. Types of adhesives include, but are not limited to, epoxies, polyurethanes, polyimides, or cyanoacrylates, silicone, or latex based adhesives.

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anterior: As used in this disclosure, anterior is a term that is used to refer to the front side or direction of a structure. When comparing two objects, the anterior object is the object that is closer to the front of the structure.

Biodegradable, Degradable, and Photodegradable: As used in this disclosure, a material is degradable if the chemical composition of the material undergoes decomposition under the conditions of normal temperature and pressure. A material is biodegradable if the chemical composition of the material undergoes decomposition by the action of microorganisms. A material is photodegradable if the chemical composition of the material undergoes decomposition when exposed to light. In the vernacular, the use of the term biodegradable often includes degradable and photodegradable materials.

Decomposition: As used in this disclosure, decomposition refers a chemical process comprising the separation of a molecule of a given atomic mass into two or more molecules or elements, each of lesser atomic mass than the original molecule. Unless stated otherwise in this disclosure, this definition excludes the radioactive processes such as radioactive decay.

Disposable: As used in this disclosure, disposable is an adjective that refers to an object that is designed and intended for a single use. Within this context, an object is disposable if it is not reusable after its initial use.

Elastic: As used in this disclosure, an elastic is a material or object that deforms when a force is applied to it and that returns to its relaxed shape after the force is removed. A material that exhibits these qualities is also referred to as an elastomeric material.

Furcate: As used in this disclosure, to furcate or furcation refers to the division of an object into a plurality branches, pieces or segments.

Grip: As used in this disclosure, a grip is an accommodation formed within an object that allows the object to be grasped or manipulated by a hand.

Hydrolysis: As used in this disclosure, hydrolysis refers to the chemical decomposition of a material through a reaction with water.

Inferior: As used in this disclosure, the term inferior refers to a directional reference that is parallel to and in the same direction as the force of gravity.

Insole: As used in this disclosure, the insole is the component of a shoe sole that is proximal to the wearer's foot.

Knurl: As used in this disclosure, a knurl refers to a small knob that projects from a surface. The knob is often, but not necessarily semi-spherical in shape. An object is referred to as "knurled" when the exterior surface of the object comprises a plurality of knurls arranged in a regular pattern.

Non-Skid Material: As used in this disclosure, a non-skid material is a material or structure that can be applied to an object such that the object is inhibited from sliding along the surface upon which the object is resting. Non-skid materials are often, but not always, adhesive or abrasive materials.

Microorganism: As used in this disclosure, a microorganism is an organism too small to be viewed by the unaided eye. Microorganisms are typically single celled organisms such as bacteria, viruses, protozoa, fungi, and algae.

Normal Temperature and Pressure: As used in this disclosure, normal temperature and pressure refers to atmospheric conditions corresponding to 20 degrees C. at 100 kPa (approx. 1 atmosphere). Normal temperature and pressure is abbreviated as NTP.

Outsole: As used in this disclosure, the outsole is the outer component of the sole of the shoe that is in contact with the ground or a supporting surface.

Oval: As used in this disclosure, an oval is a geometric shape that is formed in the shape of a "squished" circle similar in form to an ellipse. The difference between an oval and an ellipse is that an ellipse can be described by a mathematical formula while an oval has no such description. The term ovoid refers to a three-dimensional structure with an oval shape that is analogous to the relationship of an ellipsoid and an ellipse.

Perimeter: As used in this disclosure, a perimeter is one or more curved or straight lines that bounds an enclosed area on a plane or surface. The perimeter of a circle is commonly referred to as a circumference.

Posterior: As used in this disclosure, posterior is a term that is used to refer to the side of an object that is distal or in the opposite direction of the anterior side. When comparing two items, the posterior item is the item that is distal from the front of the object.

Pressure Sensitive Adhesive: As used in this disclosure, a pressure sensitive adhesive is an adhesive that is a permanently tacky adhesive that is activated by the application of pressure.

Quarter: As used in this disclosure, the quarter is the portion of a shoe connected to the vamp and that protects the heel and the sides of the foot.

Removable Adhesive: As used in this disclosure, a removable adhesive is a commercially available adhesive that is designed with a lower tack, or stickiness, such when a first object is attached to a second object with a removable adhesive, the first object can be readily removed in a manner that ideally, though not necessarily practically, leaves behind no adhesive residue on the second object. A repositionable adhesive is a subset of removable adhesives that are intended to allow the first object to be reattached to a third object or the second object in the initial or a different position. Within this disclosure, a removable adhesive is assumed to include repositionable adhesives.

Seam: As used in this disclosure, a seam is a joining of: 1) a first textile to a second textile; 2) a first sheeting to a second sheeting; or, 3) a first textile to a first sheeting. Potential methods to form seams include, but are not limited to, a sewn seam, a heat bonded seam, an ultrasonically bonded seam, or a seam formed using an adhesive.

Sheeting: As used in this disclosure, sheeting is a material, such as a textile, a plastic, or a metal foil, in the form of a thin flexible layer or layers.

Sole: As used in this disclosure, the sole component of a shoe that forms the undersurface of the shoe and comes in contact with the ground.

Superior: As used in this disclosure, the term superior refers to a directional reference that is parallel to and in the opposite direction of the force of gravity.

Supporting Surface: As used in this disclosure, a supporting surface is a horizontal surface upon which an object rests. Within this disclosure, it is assumed that the object is placed on the supporting surface in an orientation that is appropriate for the normal or anticipated use of the object.

Tack: As used in this disclosure, tack refers to a measure of the bonding strength of an adhesive. The greater the bonding strength the more tack the adhesive is said to have.

Vamp: As used in this disclosure, the vamp is the portion of a shoe that protects the foot from the toes to where the vamp connects to the quarter.

Vernacular: As used in this disclosure, vernacular is a noun that refers to the common meaning and usage of a word as opposed to a specialized or more specific meaning and usage of the same word by a person skilled in an art.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An overshoe comprising:

a vamp guard, a heel guard, an arch union, and a tab;

wherein the arch union attaches the vamp guard to the heel guard;

wherein the tab attaches to the heel guard;

wherein the overshoe is configured for use with a shoe;

wherein the overshoe is configured to attach to the sole of the shoe;

wherein the sole of the shoe is further defined with an insole and an outsole;

wherein the overshoe attaches to the outsole of the shoe;

wherein the overshoe is a disposable;

wherein the overshoe is biodegradable;

wherein the overshoe is degradable;

wherein the vamp guard is a furcation of the overshoe;

wherein the heel guard is a furcation of the overshoe;

wherein the arch union is a furcation of the overshoe;

wherein the vamp guard is configured to attach to the outsole of the sole of the shoe in an inferior position relative to the vamp of the shoe;

wherein the heel guard is configured to attach to the outsole of the sole of the shoe in an inferior position relative to the quarter of the shoe;

wherein the arch union is configured to attach to the outsole of the sole of the shoe in an inferior position relative to the arch of the shoe.

2. The overshoe according to claim 1 wherein the vamp guard comprises a vamp sheeting, a vamp plurality of knurls, a vamp adhesive layer and a vamp linear junction;

wherein the vamp plurality of knurls, the vamp adhesive layer, and the vamp linear junction are formed on the vamp sheeting;

wherein the heel guard comprises a heel sheeting, a heel plurality of knurls, a heel adhesive layer and a heel linear junction;

wherein the heel plurality of knurls, the heel adhesive layer and the heel linear junction are formed on the heel sheeting;

wherein the arch union comprises an arch sheeting, an arch adhesive layer, a first arch linear junction and a second arch linear junction;

wherein the vamp sheeting is further defined with a vamp inferior surface and a vamp superior surface;

wherein the heel sheeting is further defined with a heel inferior surface and a heel superior surface;

wherein the arch sheeting is further defined with an arch inferior surface and an arch superior surface.

3. The overshoe according to claim 2 wherein the vamp sheeting is a sheeting;

wherein the vamp sheeting is a biodegradable structure;

wherein the vamp sheeting is formed from a degradable and biodegradable polymer.

4. The overshoe according to claim 3 wherein the vamp plurality of knurls are formed on the vamp inferior surface of the vamp sheeting;

wherein each of the vamp plurality of knurls is a structure that projects away from the vamp inferior surface of the vamp sheeting;

wherein the vamp plurality of knurls forms a nonskid surface.

5. The overshoe according to claim 4 wherein the vamp adhesive layer is configured to adhere the vamp sheeting to the outsole of the sole;

wherein the vamp adhesive layer is a pressure sensitive adhesive;

wherein the vamp adhesive layer is applied as a layer to the vamp superior surface of the vamp sheeting.

6. The overshoe according to claim 5 wherein the vamp linear junction is a portion of the perimeter of the vamp sheeting that forms a straight line;

wherein the vamp linear junction forms the posterior edge of the vamp guard;

wherein the span of the length of the vamp linear junction equals the span of the first arch linear junction.

7. The overshoe according to claim 6 wherein the heel sheeting is a sheeting;

wherein the heel sheeting is a biodegradable structure;

wherein the vamp sheeting is formed from a degradable and biodegradable polymer;

wherein the sheeting that forms the heel sheeting is identical to the sheeting that forms the vamp sheeting.

8. The overshoe according to claim 7 wherein the heel plurality of knurls are formed on the heel inferior surface of the heel sheeting;

wherein each of the heel plurality of knurls is a structure that projects away from the heel inferior surface of the heel sheeting;

wherein the heel plurality of knurls forms a nonskid surface.

9. The overshoe according to claim 8, wherein the heel adhesive layer is configured to adhere the heel sheeting to the outsole of the sole;

wherein the heel adhesive layer is a removable adhesive;

wherein the heel adhesive layer is a pressure sensitive adhesive;

wherein the heel adhesive layer is applied as a layer to the heel superior surface of the heel sheeting;

wherein the heel adhesive layer is identical to the vamp adhesive layer.

10. The overshoe according to claim 9 wherein the heel linear junction is a portion of the perimeter of the heel sheeting that forms a straight line;

wherein the heel linear junction forms the anterior edge of the heel guard;

wherein the span of the length of the heel linear junction equals the span of the second arch linear junction.

11. The overshoe according to claim 10 wherein the tab is a grip;

wherein the tab is cut as an extension of the heel sheeting.

12. The overshoe according to claim 11 wherein the arch sheeting is an elastic sheeting;

wherein the arch sheeting is a biodegradable structure;

wherein the arch sheeting is formed from a degradable and biodegradable polymer;

wherein the arch sheeting is formed from a block copolymer.

13. The overshoe according to claim 12 wherein the arch adhesive layer is configured to adhere the arch sheeting to the outsole of the sole;

wherein the arch adhesive layer is a removable adhesive;

wherein the arch adhesive layer is a pressure sensitive adhesive;

wherein the arch adhesive layer is applied as a layer to the arch superior surface of the arch sheeting;

wherein the heel adhesive layer is identical to the vamp adhesive layer.

14. The overshoe according to claim 13 wherein the first arch linear junction is a portion of the perimeter of the arch sheeting that forms a straight line;

wherein the second arch linear junction is a portion of the perimeter of the arch sheeting that forms a straight line;

wherein the first arch linear junction forms the anterior edge of the arch union;

wherein the second arch linear junction forms the posterior edge of the arch sheeting.

15. The overshoe according to claim 14 wherein the sheeting used in the vamp sheeting is formed from a lactic acid (CAS 26100-51-6) polymer;

wherein the sheeting used in the heel sheeting is formed from a lactic acid (CAS 26100-51-6) polymer;

wherein the block copolymer is formed from a polymer chain made of a lactic acid (CAS 26100-51-6) polymer chain and caprolactone (CAS 24980-41-4) polymer chain;

wherein the block copolymer formed from a lactic acid polymer and a caprolactone polymer is both degradable and biodegradable.

16. The overshoe according to claim 15 wherein each of the vamp plurality of knurls is a hemisphere;

wherein the vamp plurality of knurls are arranged in a regular order;

wherein each of the heel plurality of knurls is a hemisphere;

wherein the heel plurality of knurls are arranged in a regular order.

17. The overshoe according to claim 16 wherein the arch union further comprises a first seam and a second seam;

wherein the first seam attaches the vamp linear junction of the vamp sheeting to the first arch linear junction of the arch sheeting such that the vamp linear junction of the vamp sheeting aligns with the first arch linear junction of the arch sheeting;

wherein the second seam attaches the heel linear junction of the heel sheeting to the second arch linear junction of the arch sheeting such that the heel linear junction of the heel sheeting aligns with the second arch linear junction of the arch sheeting;

wherein the first seam is formed using a heat bonding process;

wherein the second seam is formed using a heat bonding process.

18. The overshoe according to claim 17 wherein the overshoe further comprises a second instantiation;

wherein the first instantiation of the overshoe is referred to as the left sole guard;

wherein the second instantiation of the overshoe is referred to as the right sole guard;

wherein the vamp adhesive layer of the vamp inferior surface of the left sole guard is pressed against the vamp adhesive layer of the vamp inferior surface of the right sole guard;

wherein the heel adhesive layer of the heel inferior surface of the left sole guard is pressed against the heel adhesive layer of the heel inferior surface of the right sole guard;

wherein the arch adhesive layer of the arch inferior surface of the left sole guard is pressed against the arch adhesive layer of the arch inferior surface of the right sole guard.

19. The overshoe according to claim 18 wherein the left sole guard is configured to attach to the sole of a first shoe;

wherein the right sole guard is configured to attach to the sole of a second shoe.

* * * * *